US006066051A

United States Patent [19]

Liu et al.

[11] Patent Number: 6,066,051

[45] Date of Patent: May 23, 2000

[54] CUE STICK BRIDGE SLEEVE WITH SELF-CLEANING WIPERS

[75] Inventors: Gregory V. Liu; Gilbert I. Key; Thomas J. Hyson, all of Simi Valley, Calif.

[73] Assignee: Hyper-Designs, Inc., Simi Valley, Calif.

[21] Appl. No.: 09/137,370

[22] Filed: Aug. 20, 1998

[51] Int. Cl.[7] ..... A63D 15/08

[52] U.S. Cl. ..... 473/44; 473/48

[58] Field of Search ..... 473/FOR 2, FOR 42–46, 473/FOR 48

[56] References Cited

U.S. PATENT DOCUMENTS

| | | | |
|---|---|---|---|
| 3,416,794 | 12/1968 | Ciano | 473/43 |
| 3,534,959 | 10/1970 | Elswick | 473/43 |
| 4,147,346 | 4/1979 | Giannetti | 473/43 |
| 5,290,030 | 3/1994 | Medbury | 473/47 |
| 5,478,282 | 12/1995 | Possum et al. | 473/48 |

FOREIGN PATENT DOCUMENTS

| | | | |
|---|---|---|---|
| 2157576 | 10/1985 | United Kingdom | 473/44 |

*Primary Examiner*—Jeanette Chapman
*Assistant Examiner*—Mitra Aryanpour
*Attorney, Agent, or Firm*—Anthony R. Barkume

[57] ABSTRACT

A pool cue having a sliding bridge sleeve with cleaning wipers provides for a smooth linear motion of the bridge sleeve while preventing frictional resistance due to contaminant buildup between the bridge sleeve bearings and the linear shaft of the pool cue.

9 Claims, 5 Drawing Sheets

CUE STICK BRIDGE SLEEVE WITH SELF-CLEANING WIPERS

BACKGROUND OF THE INVENTION

The present invention relates to a billiard or pool cue and more specifically to a bridge sleeve which is slideably mounted on the shaft with wiper means for keeping contaminants away from the bearing surface between the bridge sleeve and the cue shaft.

DESCRIPTION OF THE PRIOR ART

Billiard cues and pool cues have a linear shaft with either a constant or tapered cross-section and may be of one-piece construction or multipart construction. In a multipart pool cue, a replaceable tip is connected to one end of the shaft and a handle or butt member attached to the other end. The butt member may have a method to adjust the amount of weight or the position of the weight within the handle. A sliding bridge sleeve may be utilized in conjunction with the shaft where the player holds the bridge sleeve in a stationary position with one hand and grasps the handle of the cue with the other hand to slide the cue laterally along its axis through the stationary bridge sleeve. The bridge sleeve provides a method to maintain a straight and steady movement of the cue and enables the player to contact a ball with greater accuracy than is possible when the player's hand is used to form the bridge. This type of device is shown, for example, in U.S. Pat. No. 5,290,030, which is incorporated by reference herein.

A similar device is taught in U.S. Pat. No. 4,147,346, where the sliding bridge sleeve is a split sleeve which may be utilized in conjunction with the tapered shaft of a pool cue. This bridge sleeve makes contact with the shaft via longitudinal ribs spaced inside the sleeve and has a hinge located along the edges of the halves of the sleeve.

Although these devices are advantageous because they allow the player to slide the cue stick smoothly and easily, it has been found that these devices disadvantageously allow the area or space between the bridge sleeve and the shaft of the pool cue to become contaminated over time by dust, dirt and oils. That is, foreign particles tend to collect on the cue shaft and enter the bridge sleeve while sliding, where the contamination will reduce or negate the primary benefit of using a bridge sleeve whereby the previously smooth linear motion will be replaced by a halting or jerky motion. Dirt and grime caught between the surfaces would potentially score or gall the bearing or shaft surface leading to early breakdown and require component replacement.

It is therefore an object of the present invention to provide a pool cue stick that overcomes these disadvantages of the prior art. It is a further object of the present invention to provide a bridge sleeve with wiper means that prevents contaminants from entering the bridge sleeve without interfering with the sliding motion-along the shaft.

SUMMARY OF THE INVENTION

In accordance with these and other objects, the present invention is a pool cue with a linear shaft having a substantially constant diameter. A bridge sleeve is slideably mounted on the shaft and has bearing means for effecting slideable movement between the sleeve and the shaft. A cleaning wiper means that forms a slideable seal along the shaft is located within the bridge sleeve, adjacent to the ends of the bridge sleeve. Removable retaining clips are mounted on each end of the bridge sleeve to maintain the wiper means within the bridge sleeve and to allow for the easy removal and replacement of the wiper means when desired.

The inside diameter of the bearing means in the bridge sleeve is configured to fit snugly over the shaft to allow for a slidable, smooth contact between the inside surface of the bearing means and the outside diameter of the shaft. The wiper means has an inside diameter essentially the same as the diameter of the shaft whereby the wiper means performs a cleaning function by rubbing smoothly against the shaft, thereby preventing contaminants from entering the contact area between the shaft and the bearing means.

Retaining clips are placed at the ends of the bridge sleeve adjacent to the wiper means. These removable clips are utilized to maintain the placement of the wiper means and allow for easy removal and replacement of the wiper means.

This self-cleaning bridge sleeve reduces the contamination by foreign debris which would otherwise collect on the surfaces between the bearing surfaces and the shaft. The wiper means performs the function of creating a slideable seal that keeps out debris to maintain the integrity of the linear motion. The wiper means may contain one wiper or more wiper mounted at each end to provide the cleaning and sealing capability.

DETAILED DESCRIPTION OF THE PREFERRED EMBODIMENT

Figure 1:
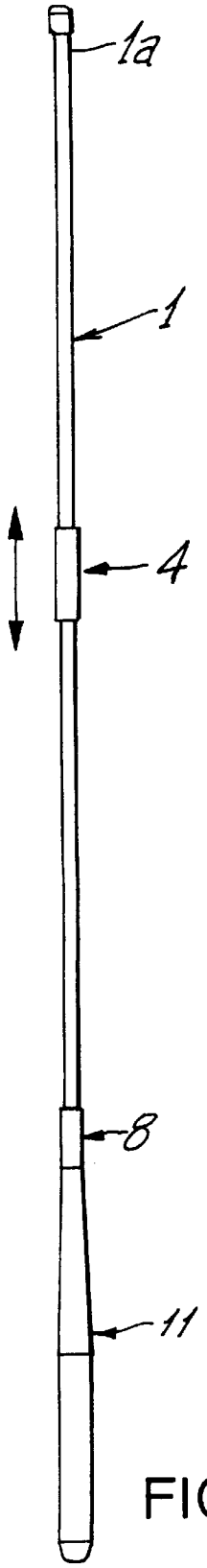
FIG. 1 is a diagram of the preferred embodiment of the present invention.
Figure 2:
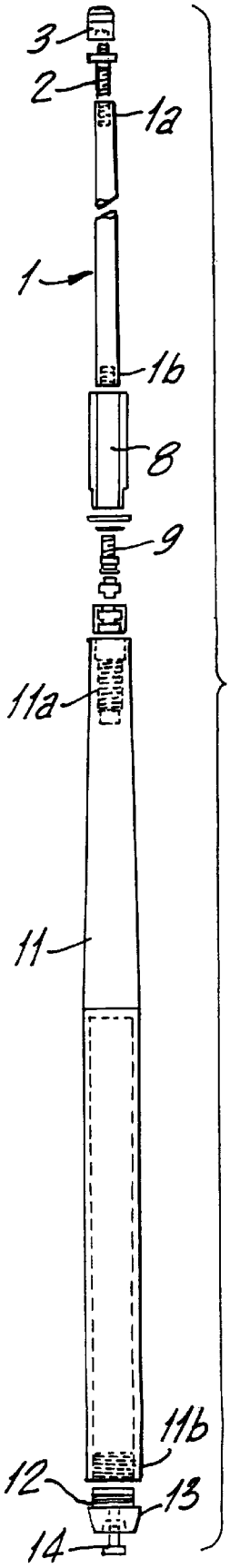
FIG. 2 is a longitudinal exploded section view of the preferred embodiment of the pool cue without the bridge sleeve.
Figure 3:
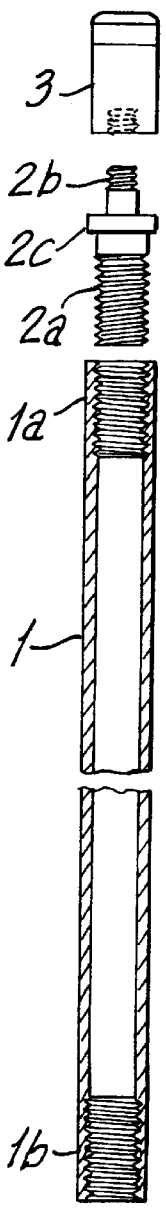
FIG. 3 is a longitudinal exploded section view of the cue tip, tip coupling and shaft.

With reference to FIG. 1, a cue stick assembly which has a longitudinal shaft 1 of cylindrical cross section, may be made of any material suitable for a pool cue, such as steel or aluminum, having a substantially constant diameter with internal threads at both ends 1*a*, 1*b* as shown,on FIG. 2 and FIG. 3.

A tip coupling 2 shown in FIG. 2 and FIG. 3 having two externally threaded ends 2*a*, 2*b* has the first end 2*a* removably attached to the first end 1*a* of the shaft 1. The second end 2*b* of the tip coupling 2 is also threaded. The tip coupling 2 has a cylindrical portion 2*c* that has a diameter larger than the diameter of the shaft 1, which will serve to prevent a bridge sleeve 4 from sliding off the shaft 1 during use. A cue tip 3 has an internally threaded base which removably attaches the second end 2*b* of the tip coupling 2.

Figure 4:
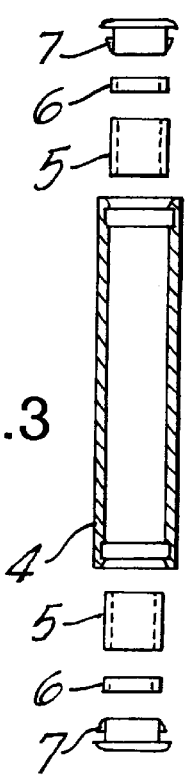
FIG. 4 is and longitudinal exploded section view of the bridge sleeve.
Figure 6:
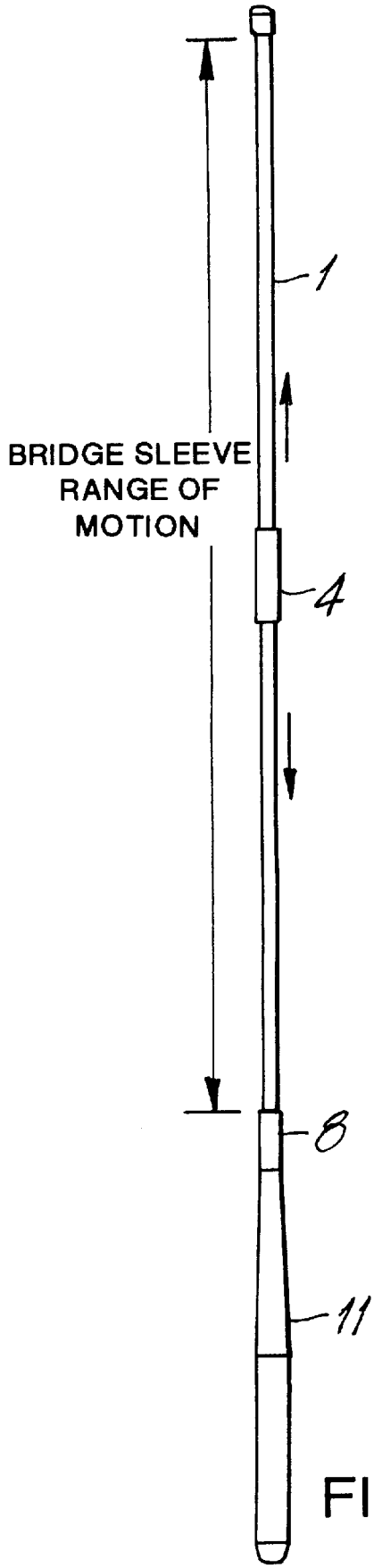
FIG. 6 is a longitudinal view of the pool cue and bridge sleeve showing the range of motion of the bridge sleeve.
Figure 7:
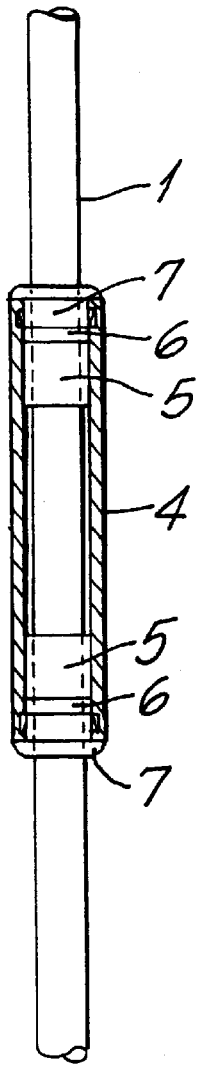
FIG. 7 is a section view of the bridge sleeve and cue shaft showing the bearing means, wiper means and retaining clip.
Figure 9:
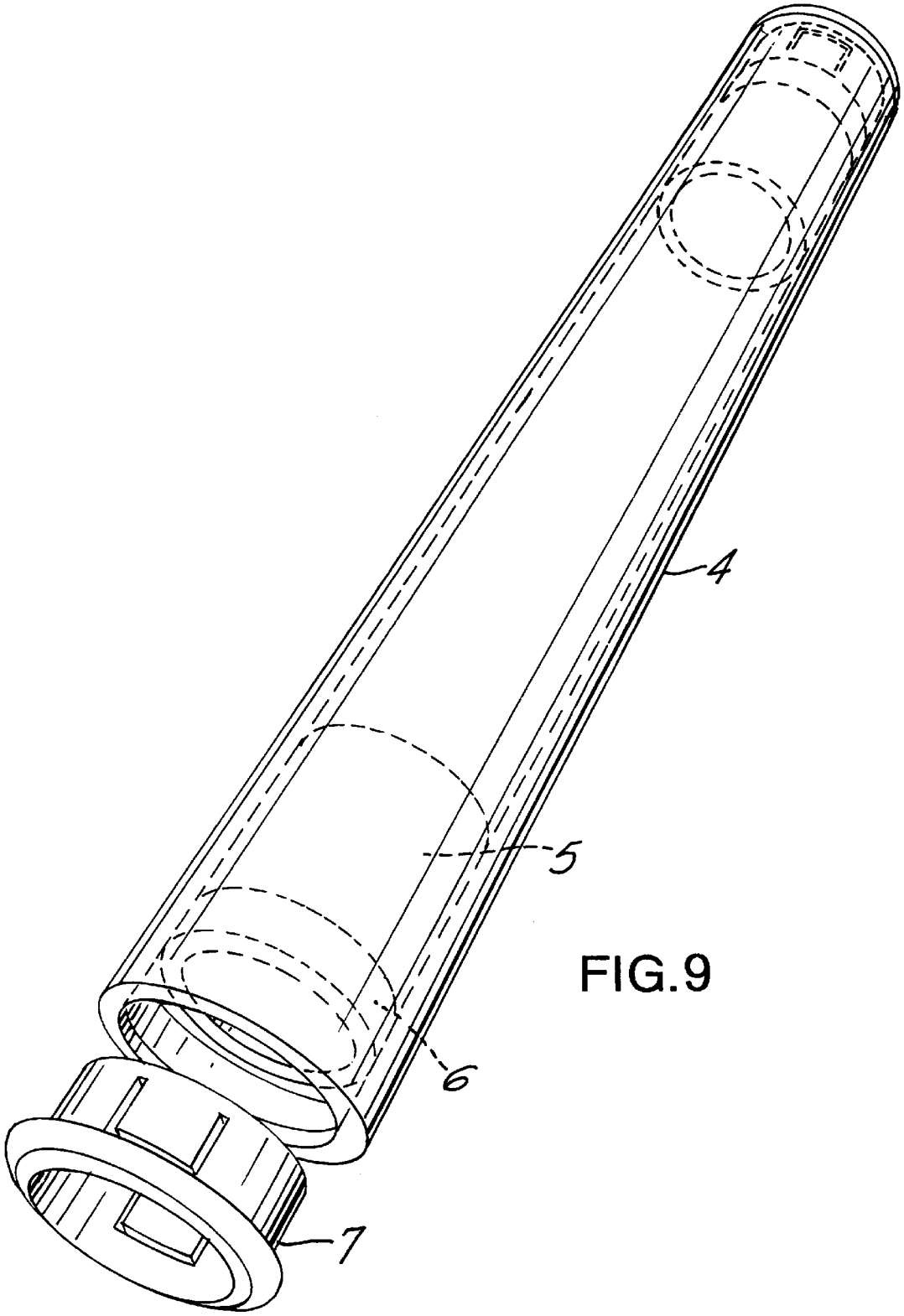
FIG. 9 is a picture of the preferred embodiment of the bridge sleeve showing the assembly of the cylindrical tube, bearing means, wiper means and retaining clips.

The bridge sleeve 4 shown in FIG. 4, FIG. 7 and FIG. 9, is a hollow cylindrical tube having an outer diameter larger than the shaft 1. Bearing means 5, which may be made of a synthetic material such as a nylon ring, are mounted within the bridge sleeve 4 as shown in FIG.7 and FIG. 9. The inner diameter of the bearing means is fabricated to correspond to the outer diameter of the shaft (wherein the actual size is based on the compressibility of the bearing material), thereby allowing the bridge sleeve 4 to slide smoothly along the shaft 1 and remain in substantial contact through its range of motion as shown in FIG. 6. In the preferred embodiment, the bearing means 5 is nylon, but other materials providing similar properties for compressibility and slideability may also be used in this invention.

A pair of cleaning wipers 6 are adjacently mounted within and near the ends of the bridge sleeve 4 to prevent the contamination of the area between the bearing means 5 and the shaft 1. The preferred embodiment of the present invention includes one wiper 6 located near each end of the bridge sleeve 4 for blocking dust and loose contaminants from entering the area between the bridge sleeve 4 and the shaft 1. Soft materials such as felt or cloth may be used in fabricating this wiper. Another embodiment of the current invention would use several wipers of different material property, stacked together, located near each end of the bridge sleeve whereby each wiper would provide a different cleaning or sealing function. Another embodiment would use a composite wiper made of several different materials, located near each end of the bridge sleeve.

The wiper means therefore may provide a plurality of cleaning and sealing functions based on the properties of the materials used in the wipers, (i.e. one for dust removal, one for oil collection) thereby maintaining the environment for a consistently smooth operation of the bridge sleeve and pool cue.

Retaining clips 7 are removably joined to the ends of the bridge sleeve to keep the wiper means 6 in place. The retaining clips 7 allow for access to the wiper means 6 and bearing means 5 for cleaning or replacement purposes.

The second end of the shaft 1*b* is connected to the grip sleeve 8. The external diameter of the grip sleeve 8 is larger than the shaft 1 (so that the bridge sleeve 4 will not slide off the shaft 1 when the pool cue is taken apart into two pieces), and is approximately the same diameter as the bridge sleeve 4 for aesthetic purposes. The internal diameter of the grip sleeve 8 is slightly smaller in diameter than the shaft 1. The grip sleeve 8 is forcibly mounted onto the second end 1*b* of the shaft 1.

The cue tip 3 is removed from the tip coupling 2 in order to slideably place the bridge sleeve 4 on the shaft 1 as shown in FIG. 7. When the cue tip 3 is reattached to the tip coupling 2, the tip 3 and grip sleeve 8 act to limit the motion of the shaft 1 through the bridge sleeve 4 (see FIG.6). This is of benefit in order to prevent the pool player from overextending the motion of the pool cue whereby the shaft would be extracted from the bridge sleeve causing a loss of control.

A male quick connect fitting 9 has a first end with threads and a second end with a protruding portion whereby it is part of a quick connection joint. The first end of the male quick connection fitting removably attaches to the inside of the second end of the shaft 1*b*.

A female quick connection fitting 10 has a first end with a shape corresponding to the second end of the male quick connection fitting and a second end which is threaded. The male and female fittings frictionally interlock to provide a temporary link between the two fittings. The male and female quick connection fittings join such that a small rotation applied to the joint will act to attach or detach the connection fittings.

Figure 5:
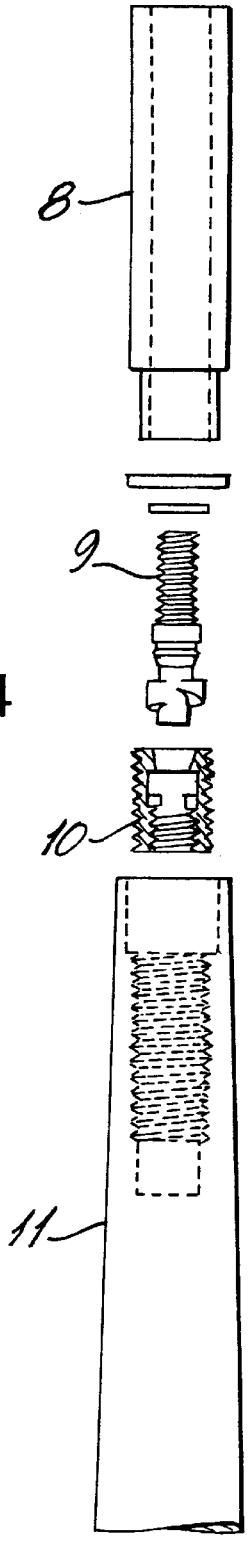
FIG. 5 is a longitudinal exploded section view of the grip sleeve, male quick connection fitting, female quick connection fitting and the handle.

A handle 11 is used by the pool player to provide movement to the pool cue. The handle is hollow and is threaded at both ends 11*a*, 11*b*. The first end of the handle 11*a* is removably attached to the second end of the female quick connect fitting 10 (see FIG. 5).

Figure 8:
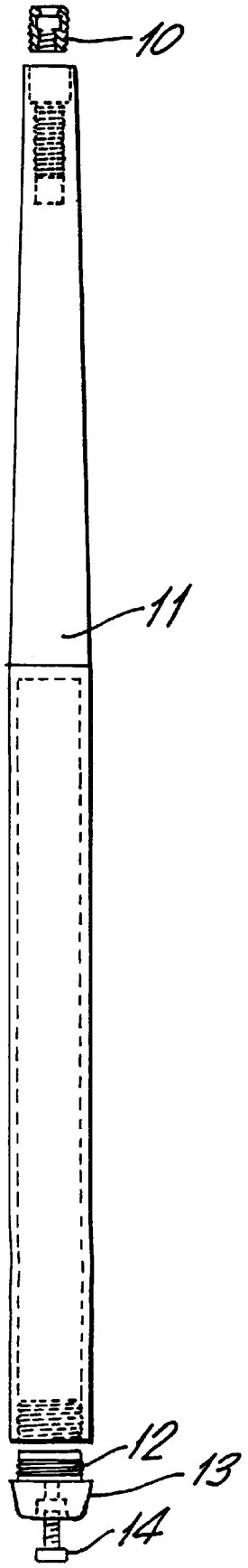
FIG. 8 is a longitudinal exploded view of the handle, weight, rubber bumper and retaining bolt.

A weighted insert 12 is provided that may be threaded into the second end of the handle 11*b*. The external diameter of the weighted insert 12 is preferably configured with a threaded surface that matches the internal thread of the second end of the handle 11*b*. The weighted insert 12 additionally has a centrally located threaded aperture that may be used to attach a rubber bumper 12 (see FIG. 8).

The rubber bumper 13 is removably attached to the end of the handle by locating a bolt 14 through the bumper 13 into the threaded aperture of the weighted insert 12 such that the bolt 14 holds the rubber bumper 13 in place.

In addition to the preferred embodiment shown herein, that comprises a pair of felt wipers located within the bridge sleeve near each end, next to a pair of nylon bearing within the bridge sleeve, the present invention contemplates variations on the preferred embodiment while still being within the spirit and scope thereof. For example, the cleaning wiper means may comprise a series of individual wipers aligned in proximity to each other (i.e. stacked next to each other) whereby each wiper is made from a material suitable to effect cleaning of a different type of contaminant. Thus, one wiper may comprise a material sufficient to absorb oils typically emanated from human skin, a second wiper could comprise a material suitable to collect lint, etc. In addition, the bearing means may comprise a series of nylon or other type of bearing sleeves, a collar of ball bearings, etc. For example, U.S. Pat. No. 4,147,346, which is incorporated by reference herein, illustrates a slideable bridge sleeve wherein ball bearings are used as bearing means to effect sliding engagement between the sleeve and the shaft. This type of bearing means could easily be used in the present invention, wherein the self-cleaning wiper means would provide the advantageous cleaning functions described herein.

What is claimed is:

1. a pool cue comprising:

a) a linear shaft having on outer surface, b) a bridge sleeve suitable for sliding engagement along the shaft, c) bearing means mounted within the bridge sleeve for effecting said sliding engagement between the bridge sleeve and the shaft, and d) wiper means located substantially within the bridge sleeve for making significant slideable contact with the outer surface of the shaft to prevent contaminants from entering the space between the bearing means and the shaft.

2. The pool cue of claim 1 wherein the bearing means is made from nylon.

3. The pool cue of claim 1 wherein the bearing means comprises two nylon bearings, each of said bearings being located substantially near opposing ends of the bridge sleeve.

4. The pool cue of claim 3 wherein the wiper means comprises two felt wipers, each of said wipers located at opposing ends of the bridge sleeve and adjacent to each nylon bearing.

5. The pool cue of claim 1 wherein the wiper means comprises a plurality of wipers of different materials.

6. The pool cue of claim 1 wherein the wiper means comprises a composite wiper bonded from several materials.

7. The pool cue of claim 1 further comprising means for retaining the wiper means within the bridge sleeve.

8. The pool cue of claim 7 wherein the means for retaining the wiper means comprises a retaining clip.

9. The pool cue of claim 8 wherein the retaining clip is made of plastic.

* * * * *